US006526678B2

(12) United States Patent
Waddington, Jr.

(10) Patent No.: US 6,526,678 B2
(45) Date of Patent: Mar. 4, 2003

(54) DEMO-DOZER

(76) Inventor: John Albert Waddington, Jr., 21103 Brush Rd., Los Gatos, CA (US) 95033

( * ) Notice: Subject to any disclaimer, the term of this patent is extended or adjusted under 35 U.S.C. 154(b) by 0 days.

(21) Appl. No.: 09/799,892

(22) Filed: Mar. 7, 2001

(65) Prior Publication Data

US 2002/0124442 A1 Sep. 12, 2002

(51) Int. Cl.[7] ..... E02F 3/96; E02F 3/76

(52) U.S. Cl. ..... 37/406; 37/403; 37/407; 172/811; 414/729

(58) Field of Search ..... 37/403, 404, 405, 37/406, 407, 408, 409, 410, 466, 468; 172/810, 811; 414/724, 729, 912; 294/68.1, 68.4, 111

(56) References Cited

U.S. PATENT DOCUMENTS 2,979,215 A * 4/1961 Brisson ..... 37/264
3,043,032 A * 7/1962 Discenza ..... 37/142.5
3,452,888 A * 7/1969 Larson et al. ..... 180/331
3,485,396 A * 12/1969 Lundquist ..... 294/88
3,842,999 A * 10/1974 Asbury ..... 414/724
4,925,359 A * 5/1990 Dunnegan ..... 414/704
5,253,449 A * 10/1993 Webb et al. ..... 37/444
5,297,351 A * 3/1994 Cote ..... 37/232
5,472,249 A * 12/1995 Fiedler ..... 294/2
5,921,302 A * 7/1999 Petersen ..... 144/24.12
6,070,345 A * 6/2000 Akaki et al. ..... 37/407
6,088,938 A * 7/2000 Logan ..... 37/404
6,267,547 B1 * 7/2001 Lund ..... 294/68.1
6,301,809 B1 * 10/2001 Staggs, Jr. ..... 37/444

* cited by examiner

*Primary Examiner*—Thomas B. Will
*Assistant Examiner*—Thomas A. Beach
(74) *Attorney, Agent, or Firm*—William W. Burns, Esq.

(57) ABSTRACT

Improvements to a grapple bucket which combine to convert the grapples into bulldozing, scraping, and hooking implements that can bulldoze, scoop, tear, and demolish more easily than a simple grapple bucket.

4 Claims, 8 Drawing Sheets

DEMO-DOZER

STATEMENT AS TO RIGHTS TO INVENTION MADE UNDER FEDERALLY SPONSORED RESEARCH AND DEVELOPMENT

NONE—No Federal Sponsorship

CROSS-REFERENCE TO RELATED APPLICATIONS

NONE

BACKGROUND OF THE INVENTION

I. Field of the Invention

The present Invention relates to improvements to the grapple bucket of a tractor, such as a Bobcat™ or Caterpillar™, or the like, which allows the bucket to be used for all types of earth moving, cutting, demolition, and similar activities. In the instant Invention, sturdy metal dozer plates are secured by welding to the grapple forks of the Bucket. In an alternate embodiment side plates are bolted to the bucket to increase the Bucket capacity.

II. Description of the Related Art

Conventional optional equipment for tractors such as the Bobcat™ or Caterpiller™ include a series of buckets and blades which require considerable expense for the option and labor cost and time to convert from one option (bucket) to another (dozer blade). Considerable expense is incurred to transport a series of bulky buckets and blades to a job site. Options which are disclosed in the prior art include:

(a) U.S. Pat. No. 6,126,216 (issued Oct. 3, 2000 to Tollefson) attaches two (2) buckets to hydraulic grapple assemblies which would normally be used to lift logs. The buckets allow the unit to pick up and transfer bulk material. This unit would be able to clear ground of bulk material, but it would not be able to do the many operations of the present Invention such as demolition, scraping, digging, and the like.

(b) U.S. Pat. No. 6,024,160 (issued Jun. 13, 2000 to Brunbaugh, et al.) which describes the combination of a several spaced hydraulically operated grapple arms which operate to draw articles into a bucket. This Invention does teach the dozer or scraper blade of the present Invention.

(c) U.S. Pat. No. 5,918,389 (issued Jul. 6, 1999 to Hall) which describes a scraper blade attached to the teeth of the bucket of a backhoe or like earth working machine. The blade in this Invention allows a hydraulically operated bucket to scrape the ground back toward the tractor.

(d) U.S. Pat. No. 5,123,185 (issued Jun. 23, 1992 to Pollard) which describes a jaw bridge that works in combination with a tractor bucket to allow the tractor to grasp bulky objects.

The present Invention provides improvements in grapple bucket design which make the bucket and tractor more versatile, able to perform functions that normally require at least several different options such as a dozer blade, grapple bucket, and scoop bucket.

SUMMARY OF THE INVENTION

The general purpose of the present Invention, which will be described subsequently in greater detail, is to provide a new and improved bucket grapple or grapple bucket for a tractor which increases the versatility of a tractor. A grapple bucket is task limited due to its design. The forks have very small surface which limits use of that option (grapple bucket) to the loading of objects that can be grasped.

More specifically the Demo-Dozer attachments to the standard grapple bucket change the bucket to a versatile option that can perform a great variety of tasks that were not possible with the grapple bucket alone. In the preferred embodiment of this Invention the tractor is equipped with a bucket which has two (2) hydraulically operated twin fork grapples. The grapples work independently. Without the attachments of the present Invention, the bucket cannot act as a dozer or demolition tool.

The Demo-Dozer attachments are comprised of a rectangular, resilient, steel plate and angle iron which is backed by a separate rectangular steel plate which extends the full length of the angle iron. Separate Demo-Dozer attachments are secured to each pair of grapple forks. In the preferred embodiment, the Demo-Dozer attachments are secured to the grapple fork by welding, however, other equivalent means for securing the Demo-Dozer attachments are considered appropriate. As designed, the angle iron portion of each Demo-Dozer attachment unit extends beyond the grapple forks by about 6 inches to create hooking implements. This feature allows the operator to hook and pull objects.

In operation the Demo-Dozer performs like the fingertips of a hand closing allowing the operator to pick up very small objects individually or in large groups. With the Demo-Dozer attachments, the tractor operator can grab a section of fence and lift it out of the ground in one motion, fence posts, concrete anchors, and all. With the Demo-Dozer attachments, the tractor and modified bucket grapple can efficiently break up and remove concrete and asphalt. The modified bucket grapple works well as a bulldozer and scraper to level the ground, to push dirt for backfilling holes, trenches or to push dirt into piles. The extended angle iron of the attachments can hook and uproot trees or shrubs and hook and pull down structures.

There has thus been outlined rather broadly the important features of the present Invention in order that the more detailed description thereof that follows may be better understood and in order that the present contributions may be better appreciated. There are, of course, additional features of the Invention that will be described hereafter plus other embodiments all of which will form the subject matter of the claims appended hereto. Those skilled in the art will appreciate that the concept upon which this disclosure is based may readily be utilized as a basis for carrying out the several purposes of the present Invention. It is important, that the claims be regarded as including such equivalent construction so far as they do not depart from the spirit and scope of the present Invention.

As such it is an object to provide attachments to a grapple bucket or bucket grapple which improve the versatility of the bucket to allow bulldozing, scraping, demolition, and scooping and lifting loose objects.

It is another object of the present Invention to increase the versatility of a grapple bucket or bucket grapple such that the single unit can do the work of multiple buckets or blade attachments.

It is another object of the present Invention to increase the versatility of a grapple bucket or bucket grapple such that the single unit can do the work of multiple bucket or blade attachments.

It is a still further object of the present Invention to reduce the cost of use of a tractor by reducing the number of blade or bucket attachments it must use and reducing the down-time and labor costs to change such attachments.

These together with other objects of the Invention along with features of novelty which characterize the Invention, are pointed out with particularity in the claims annexed to and forming a part of this disclosure. For a better understanding of the Invention, its operative advantages, and the specific objects attained by its uses, reference should be had to the accompanying drawings, and descriptive matter in which there is illustrated preferred embodiments of the Invention.

DESCRIPTION OF THE PREFERRED EMBODIMENT

The present Invention presents modifications to a grapple bucket or bucket grapple that is an optional attachment for a bucket or scoop loader tractor. The modifications greatly increase the versatility of the bucket and tractor, and increase the range of jobs the tractor can perform. In essence, the Demo-Dozer attachment takes a very limited task grapple bucket and turns the grapple bucket into a multi-task bucket. The modified bucket eliminates the need to buy separate task specific buckets for each job, and it reduces the need and cost to transport more than one bucket to a job site.

Figure 1:
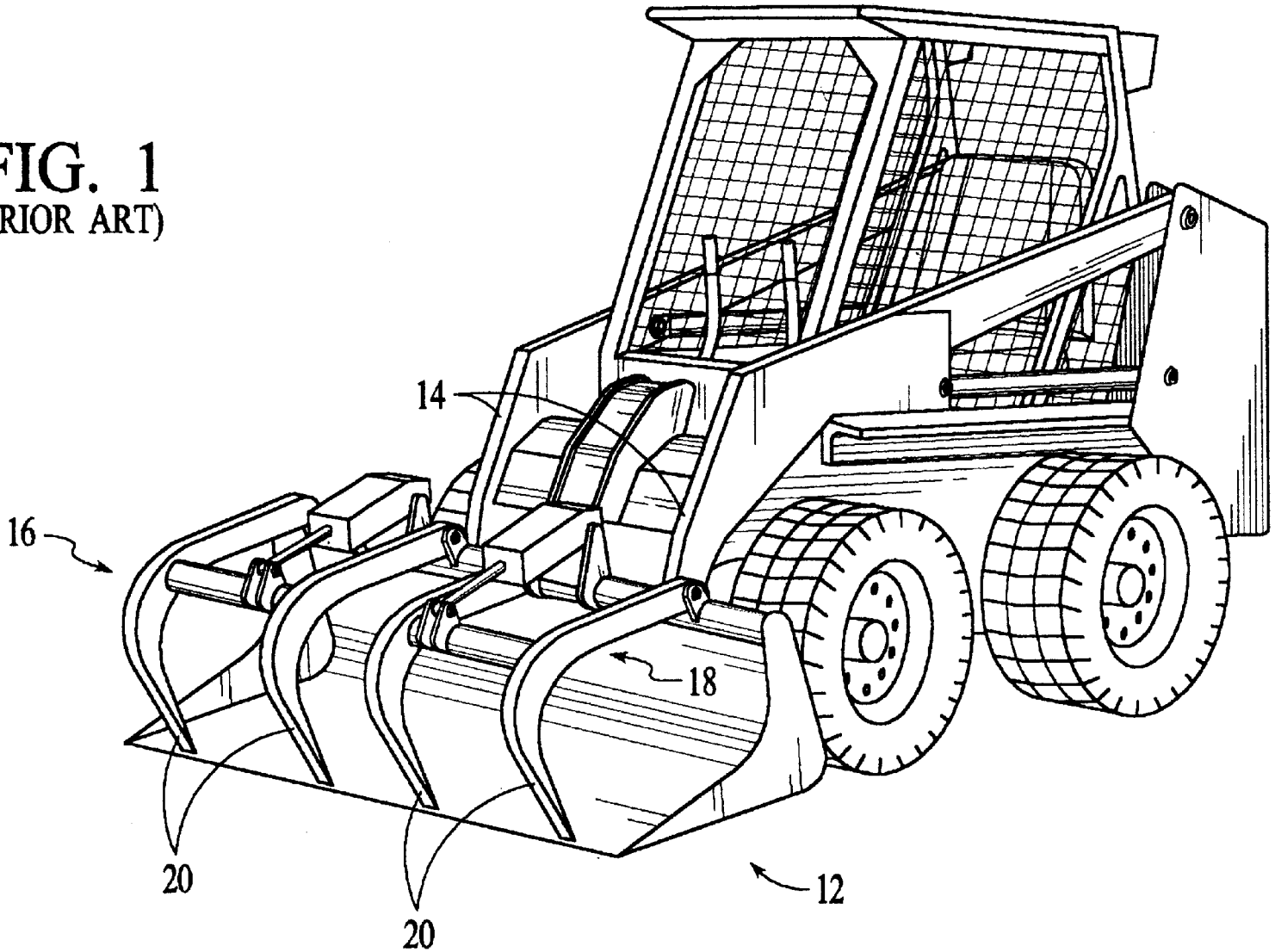
FIG. 1 (PRIOR ART)
FIG. 1 presents in perspective views a tractor with a grapple bucket as it exists in the prior art.
Figure 2:
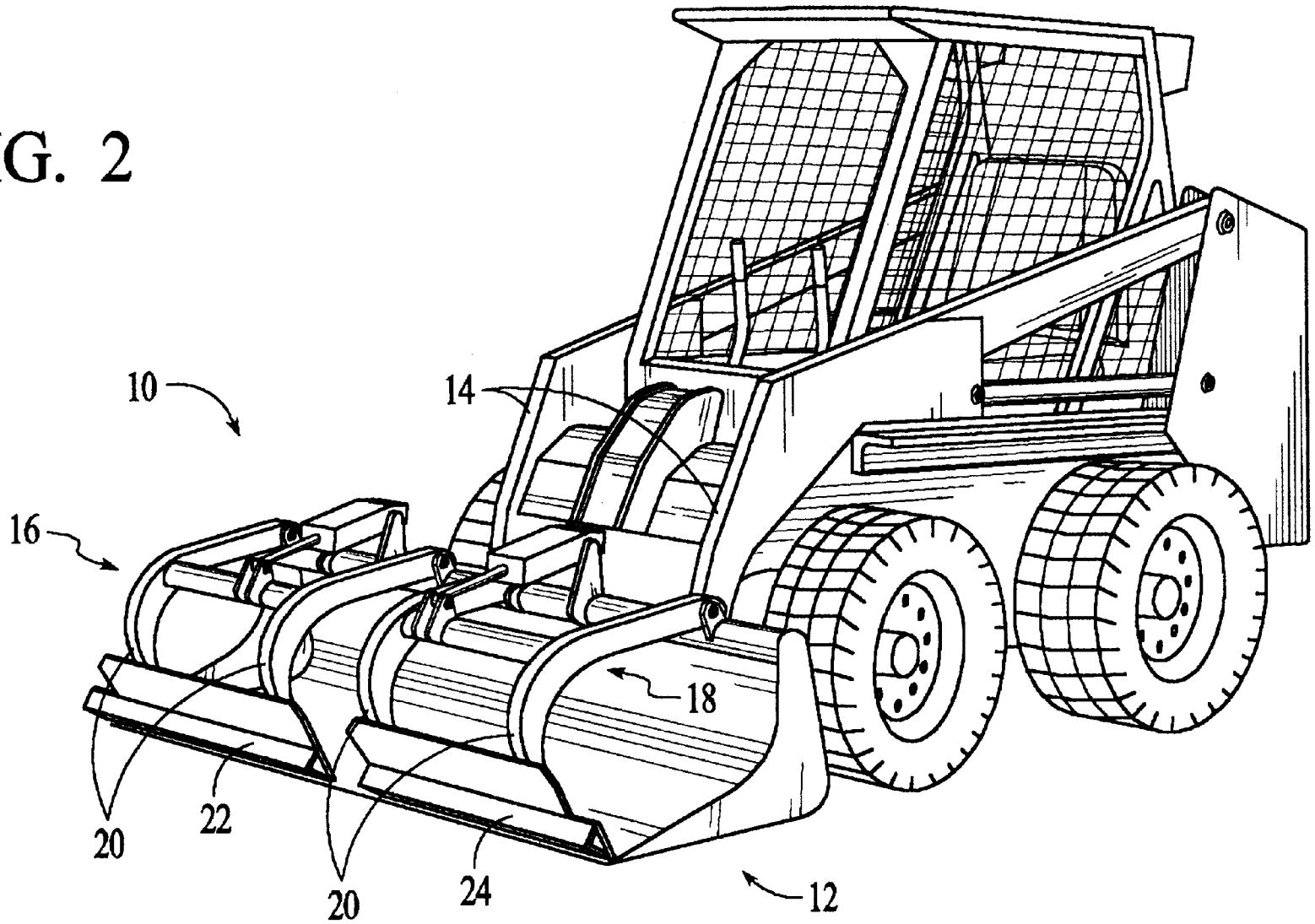
FIG. 2 presents in perspective view a tractor with a grapple bucket to which the Demo-Dozer attachments are secured.
Figure 3A:
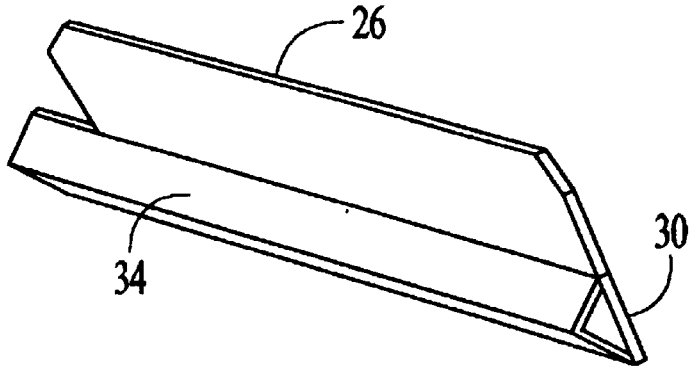
FIGS. 3A and 3B presents a perspective view of the Demo-Dozer attachments for left and right grapples with overlying angle iron attached.
Figure 3B:
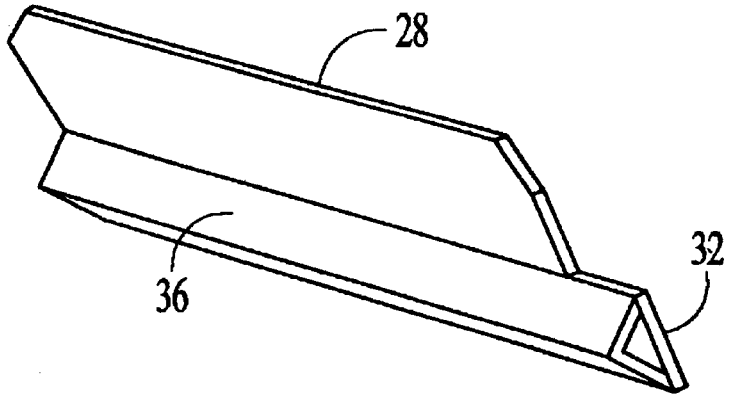
Figure 9:
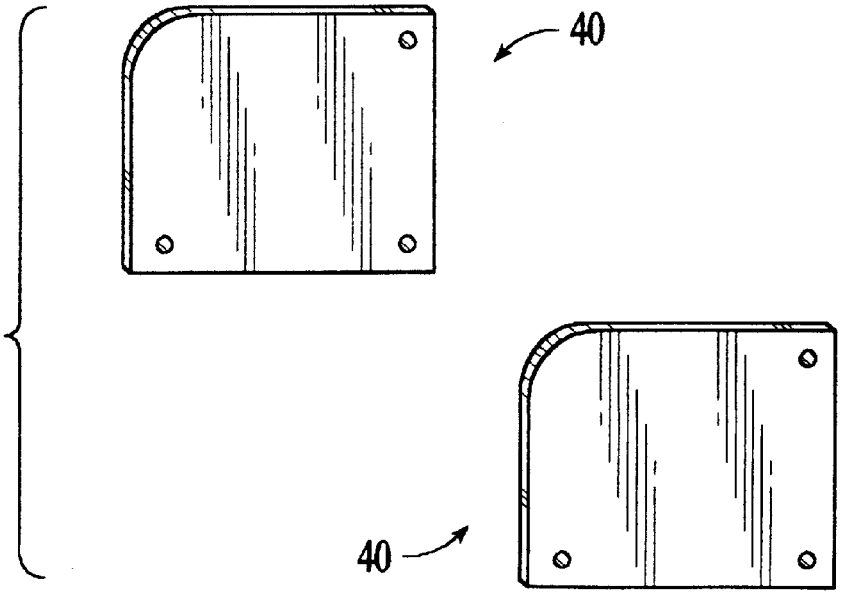
FIG. 9 presents the pair of side plate attachments which when bolted in place increase the volume of the grapple bucket.

In the preferred embodiment 10, the grapple bucket of a standard grapple bucket, as shown in the prior art, drawing of FIG. 1 is modified by the installation of the Demo-Dozer attachment of the present Invention. The standard grapple bucket 12 is pivotally attached to the spaced lift arms 14 of a tractor. The bucket is rotated by a hydraulic tilt cylinder that is pivotally connected to the rear wall of the bucket 12. Two grapples, 16 and 18, each of which is comprised of a pair of spaced forks 20 are pivotally attached for independent rotary movement at the top of the rear wall of the bucket 12. The grapples 16 and 18 are independently activated by hydraulic cylinders. Two (2) Demo-Dozer attachments, as shown in FIG. 3, are utilized. Separate Demo-Dozer attachments are secured to the forks 20 of each grapple 16 and 18, by welding. The Demo-Dozer attachments 22 and 24 are comprised of upper plates 26 and 28 and lower plates 30 and 32 which are welded to the spaced forks of the grapples 16 and 18. The upper plates 26 and 28 are ⅜ inch thick steel rectangles that are welded across the forks 20 of the grapples 16 and 18. The outer edges of the plates 26 and 28 extend beyond the forks 20. At the midpoint of the bucket 12, a gap remains between the edges of the plates 26 and 28.

The upper edge of each of the lower plates 30 and 32 abut the lower edges of the upper plates 26 and 28. The lower plates 30 and 32 are elongated rectangles of ½ inch steel plate. The lower plates 30 and 32 extend from alignment with the central edge of the upper plates to the inner side walls of the bucket 12. Overlying and welded to the lower plates 30 and 32 are sections of ¼ inch angle iron 34 and 36 which are cut to the same rectangular dimensions as the plates 30 and 32.

The standard grapple bucket 12 shown in FIG. 1 does not competently scoop and carry loose materials, such as soil, gravel, or the like. The second embodiment of present Invention, as shown in FIG. 8 incorporates the Demo-Dozer attachment as previously described and a set of side plates 40 bolted in place at each side of the grapple bucket to increase the capacity of the bucket.

Figure 4:
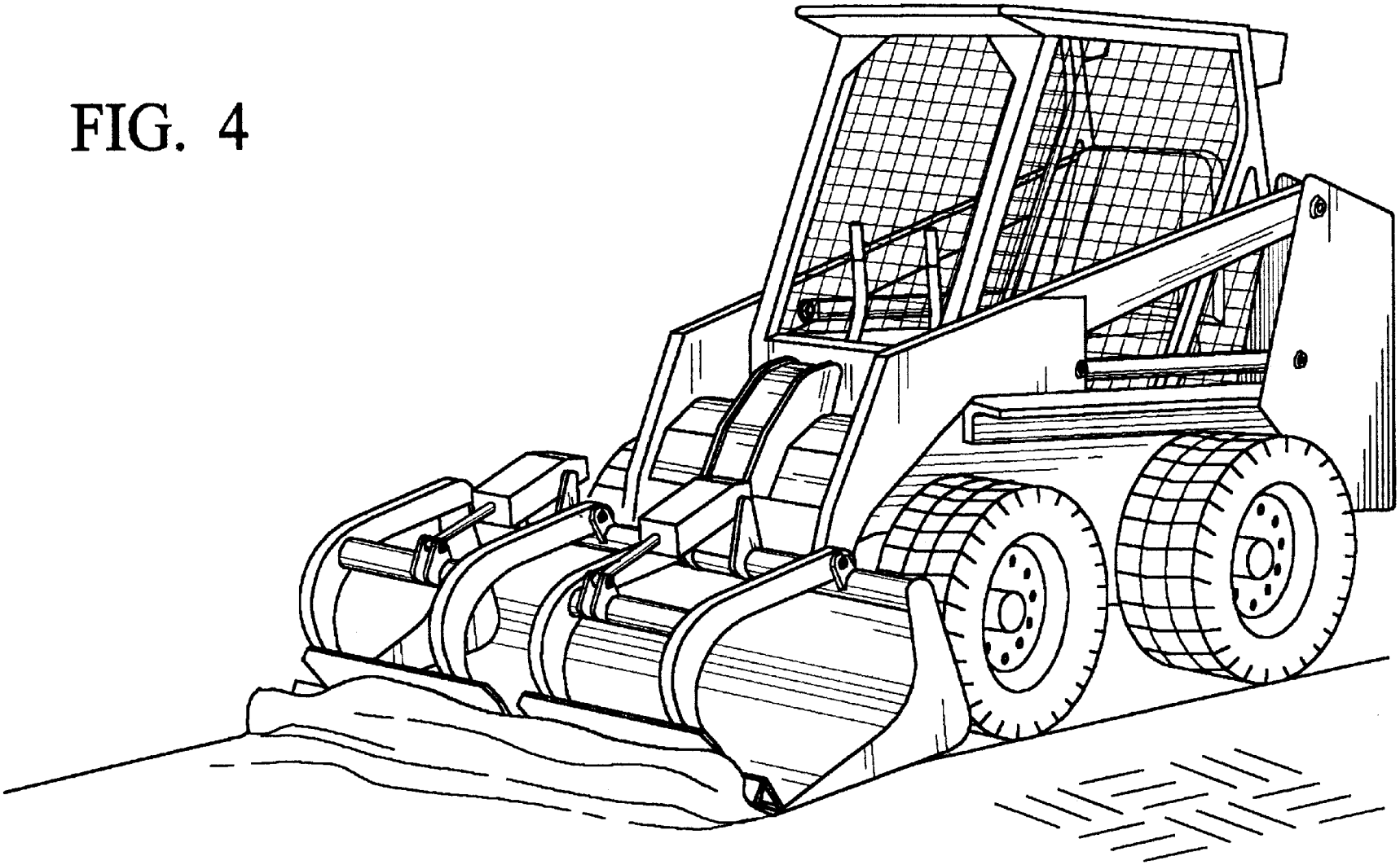
FIG. 4 presents a perspective view of the tractor with Demo-Dozer attachments installed in use bulldozing earth.

In operation, the grapple bucket 12 with the Demo-Dozer attachment installed acts almost like the fingers of a hand closing, allowing the operator to pick up very small objects, individually or many at one time as a result of the surface area presented by the Demo-Dozer across the entire lip of the bucket 12. The tractor as shown in FIG. 4 can operate as a bulldozer utilizing the Demo-Dozer attachment. With the grapples fully closed, the tractor can move heavy masses of earth in front of it to clear debris and level the ground. The grapple bucket with the Demo-Dozer attachment can also make fairly precise cuts. As an example, with the grapples closed and the bucket rotated forward, the operator can make a 2 inch cut without gouging.

Figure 5:
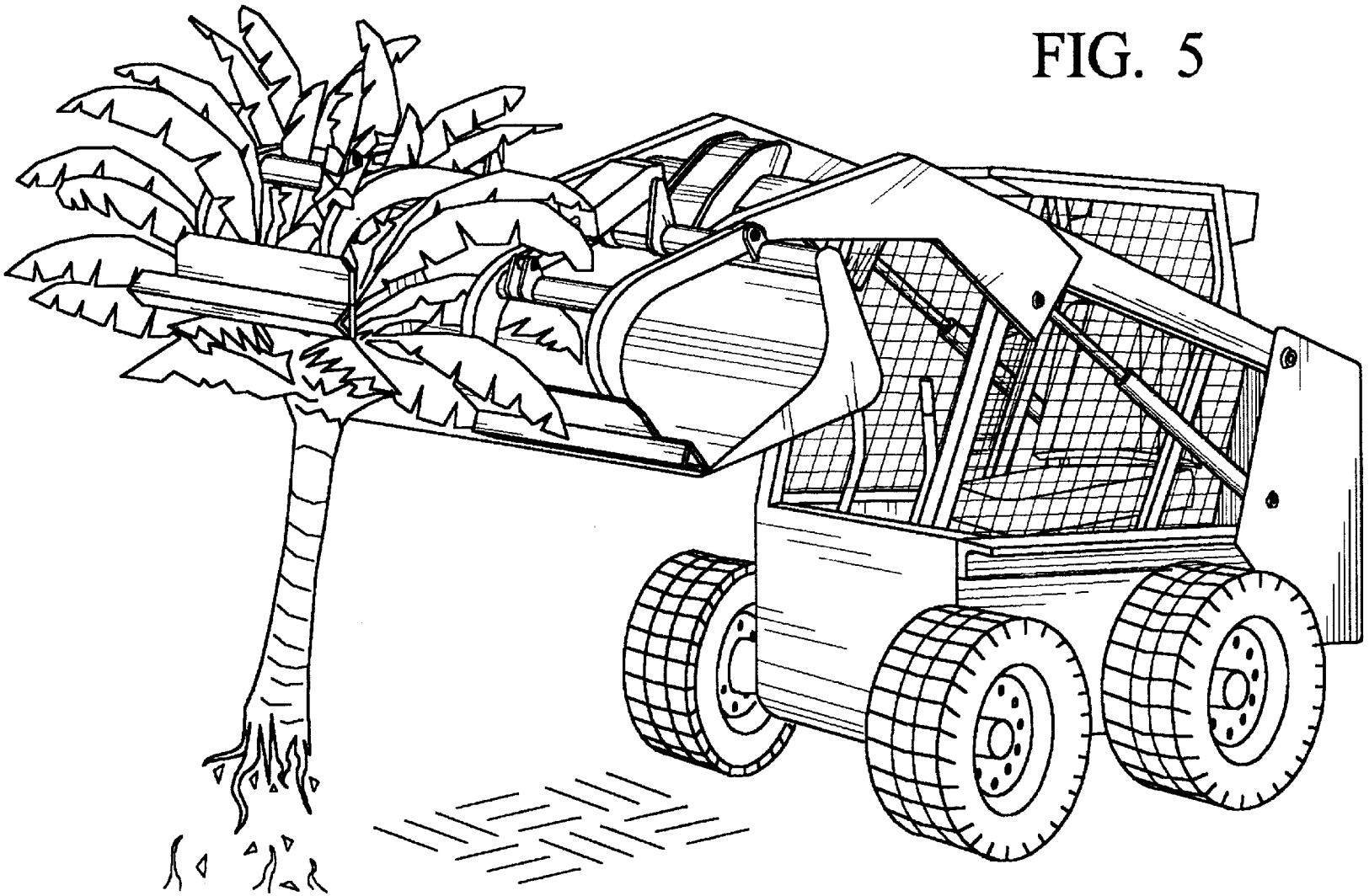
FIG. 5 presents a perspective view of the tractor with Demo-Dozer attachments installed uprooting a tree.
Figure 6:
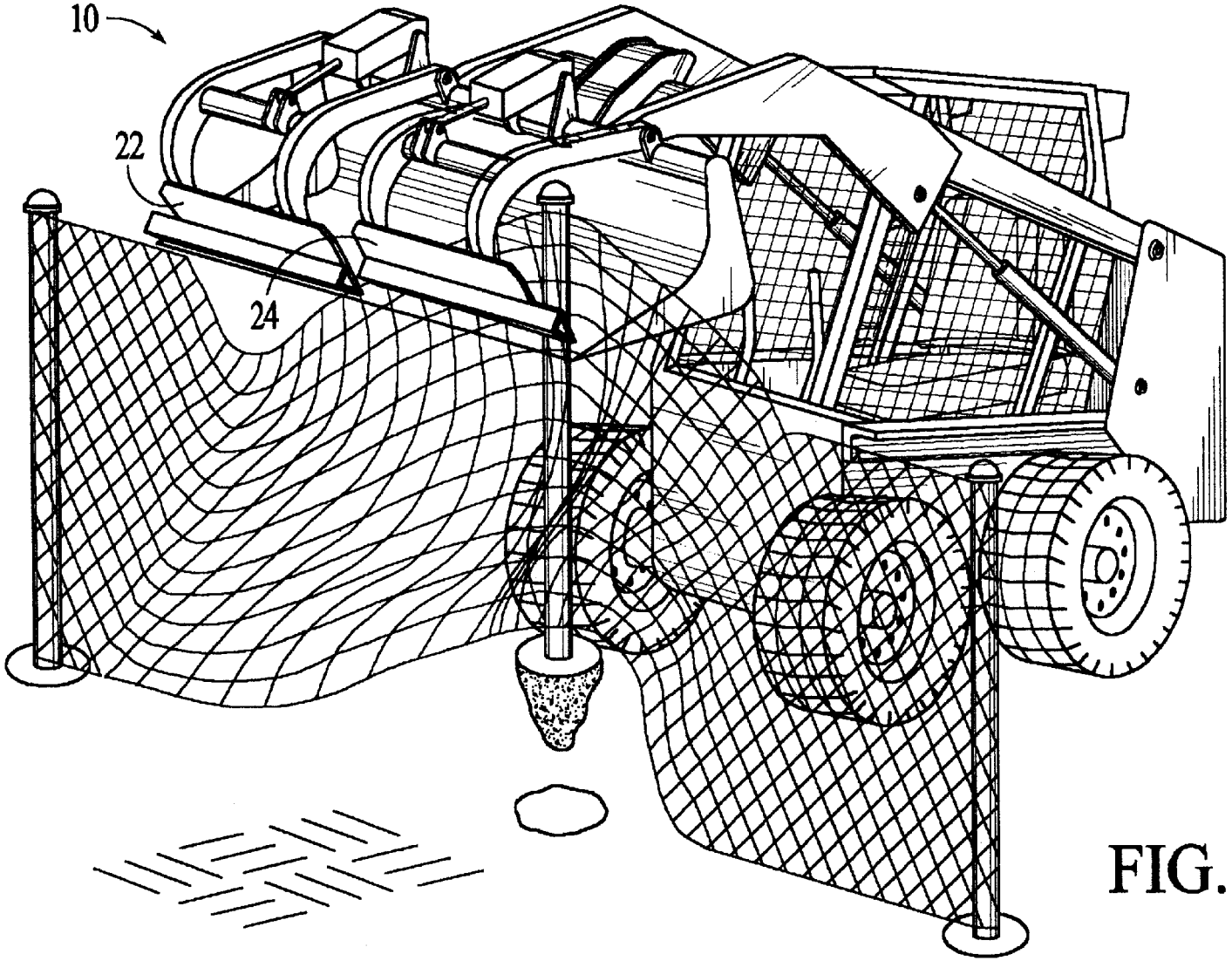
FIG. 6 presents a perspective view of the tractor with Demo-Dozer attachments installed tearing out a steel fence.
Figure 7:
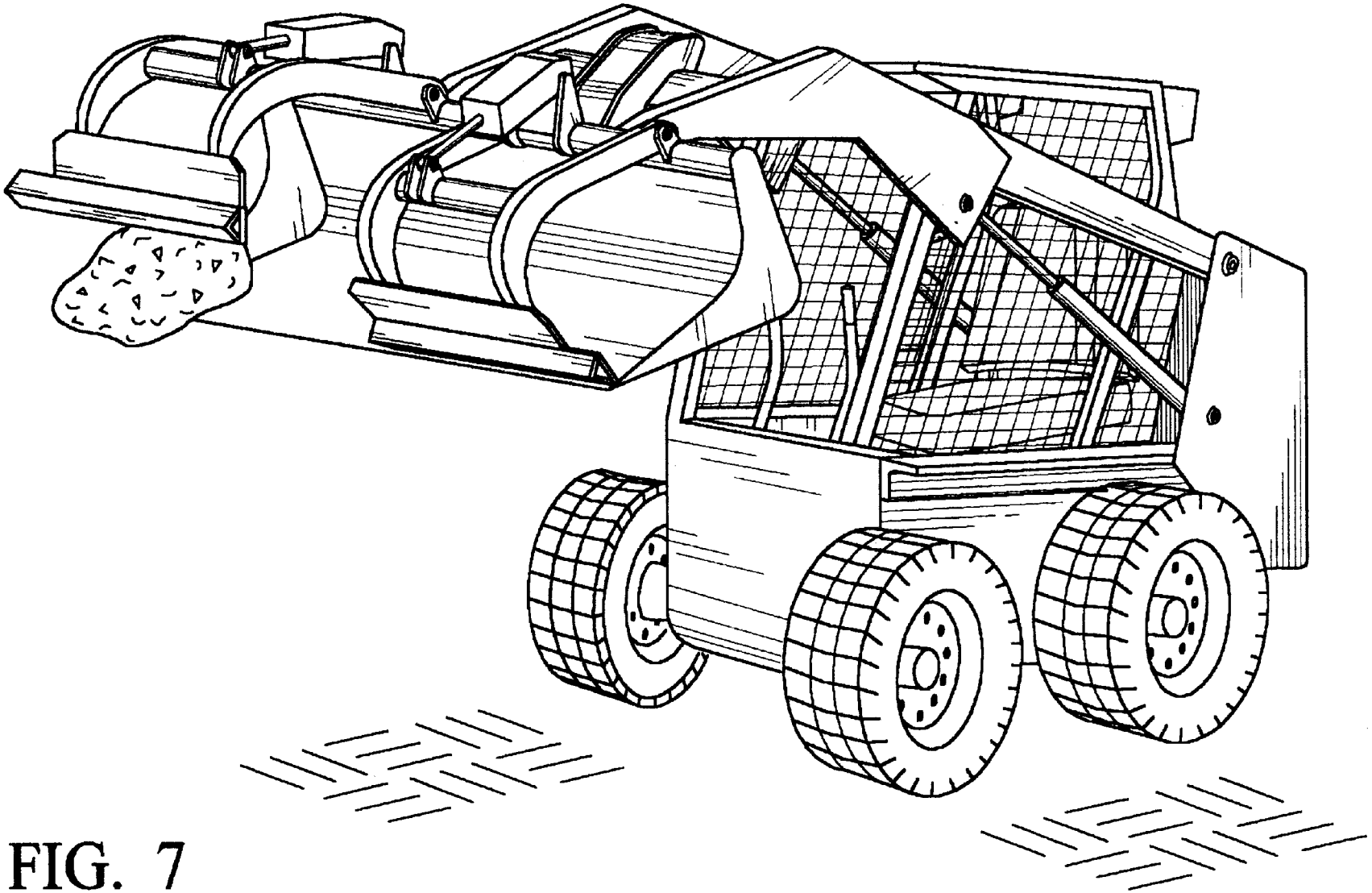
FIG. 7 presents a perspective view of the tractor with Demo-Dozer attachments installed grabbling and lifting a large boulder.

The tractor with grapple bucket and Demo-Dozer attachment as shown in FIG. 5 can reach over or around a tree with one grapple working independently, grab the tree and pull it out by the roots. And as shown in FIG. 6, the tractor with Demo-Dozer equipped grapple bucket can easily remove chain link fences with metal posts set in concrete. The operator can operate the grapples independently, reaching over and around the posts, and pulling them over. The outer 6 inches of the lower plate or bar on each side of the grapples extends to the edge of the bucket. These extensions allow the operator with the grapples opened to hook around trees, posts or studs and pull the objects over. The extensions allow the operator to rip and tear objects when doing demolition work FIG. 7 illustrates the use of the Demo-Dozer equipped grapple bucket to grab, pick up, and carry a boulder. One of the grapples is opened and closed independently to clutch the boulder and move it to a desired location.

Figure 8:
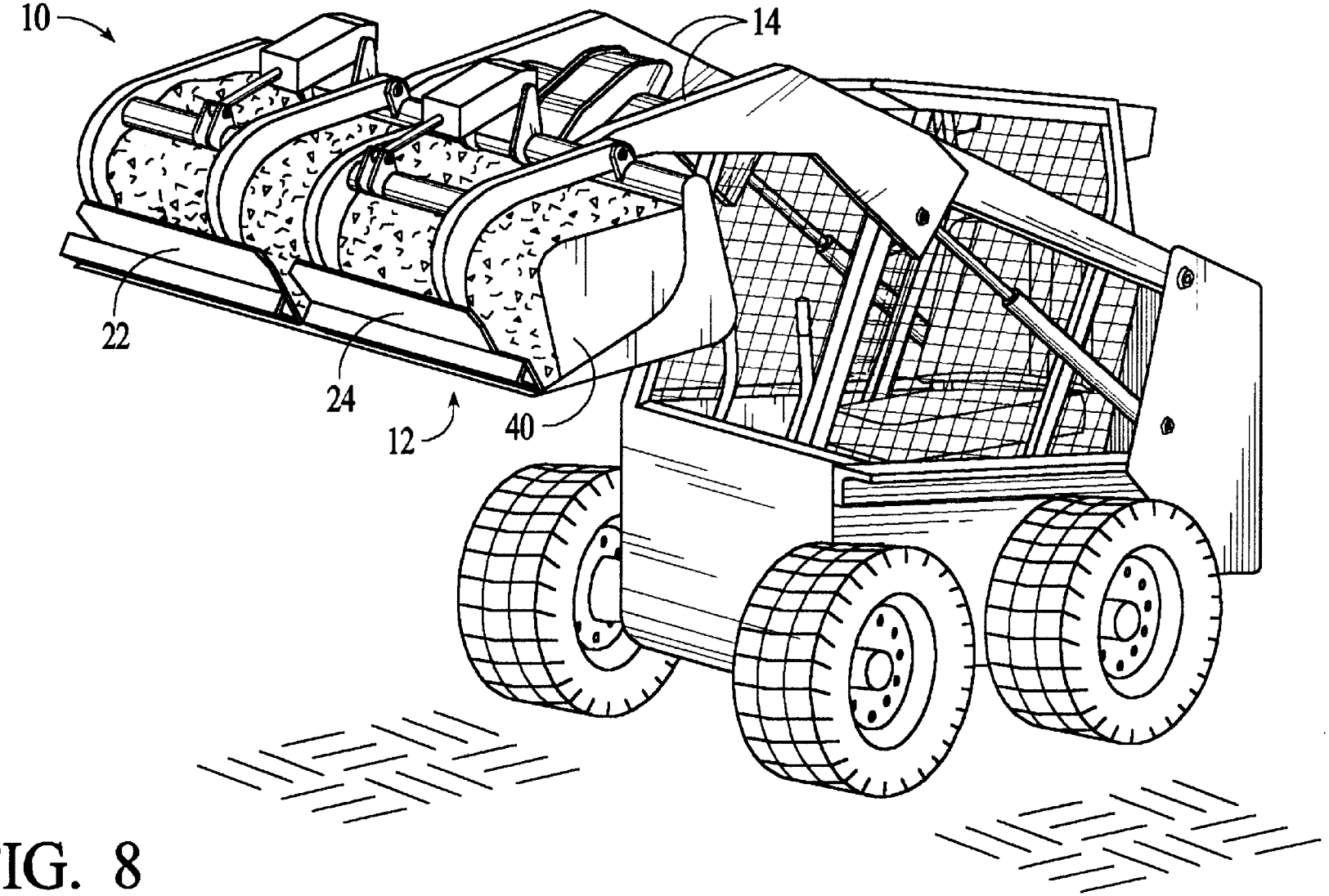
FIG. 8 presents a perspective view of the tractor with both the Demo-Dozer attachments and the side plates of the second embodiment installed as it lifts and transports a load of loose material.

FIG. 8 illustrates the second embodiment with the Demo-Dozer attachments installed on the forks of the grapples and a pair of side plates 40 bolted in place. The operator has scooped and held a bucket full of loose material such as gravel or loose earth and is ready to deliver the load to a desired location.

While the Invention has been described with reference to the specific embodiments described, those descriptions are only illustrative and are not to be construed as limiting the Invention. With respect to the above descriptions, then, it is to be realized that the optional relationships for the parts of the Invention include various in size, materials, shape, configurations, form, function, power, energy, and manner of operations assembly and use and are deemed readily apparent and obvious to those skilled in the art and all equivalent relationships to those illustrated in the drawings and described in the specifications are intended to be encompassed by the present Invention.

Therefore, the foregoing is considered as illustrative only of the principles of the Invention. Further, since numerous modifications and changes will readily occur to those skilled in the art, it is not desired to limit the Invention to the exact construction and operation shown and described and accordingly, all suitable modifications and equivalents may be considered to be within the scope of the Invention.

What is claimed as being new and desired to be protected by Letters Patent of the United States is as follows:

1. In a grapple bucket for use with a tractor, having one or more independently articulated grapples, the improvements comprising:

a) an upper rectangular plate overlying and secured to each grapple, and b) a lower, narrow, rectangular plate, overlying and secured to the grapple and to the upper plate, the lower plate extending to the inside edge of the bucket such that the combination of the upper and lower plates allow an operator of a tractor, equipped with the improvements to bulldoze and scrape earth, scoop loose materials, demolish and pull down structures, fences, trees, and posts.

2. The grapple bucket of claim NO. 1 wherein angle iron congruent to the shape of the lower plate is secured to the back of the lower plate to stiffen the lower plate.

3. The grapple bucket of claim NO. 2 wherein the lower plate extends to the inside edge of the bucket, a length of approximately 6 inches beyond the edge of the grapple.

4. An attachment to a grapple bucket, having a plurality of articulated grapples, comprising: upper and lower rectangular metal plates, the lower plate being narrower than the upper plate and extending beyond the outer edge of the grapple to the inner edge of the bucket and secured to the upper plate; angle iron, congruent to the lower plate, secured to the lower plate to provide strength and rigidity to the lower plate; said grapples being spaced apart to allow the grapple bucket to grasp objects with the grapples rotated separately and independently like the fingers of a band to grab or grasp objects from the center or sides of the bucket; side plates bolted to the sides of the bucket, wherein the grapple with the attachment can bulldoze and scrape and scoop earth or loose materials, and hook around and pull down trees, poles and fence posts and hook under, uproot, and break concrete foundations and slabs.

* * * * *